United States Patent [19]

Schaefer, IV et al.

[11] 4,390,170

[45] Jun. 28, 1983

[54] CLOSURE PLUG FOR LADLE CAR

[76] Inventors: Louis B. Schaefer, IV, 810 Beechwood Dr., Medina, Ohio 44256; Thomas M. Miller, 26027 Byron Dr., North Olmsted, Ohio 44070

[21] Appl. No.: 359,774

[22] Filed: Mar. 19, 1982

[51] Int. Cl.[3] ..... C21C 5/46

[52] U.S. Cl. ..... 266/272; 266/165; 266/271; 266/286

[58] Field of Search ..... 266/271, 272, 273, 287, 266/165, 286, 45, 283; 222/563, 546, 597, 563, 567; 49/40, 34; 220/209, 213, 287

[56] References Cited

U.S. PATENT DOCUMENTS

| | | | |
|---|---|---|---|
| 771,675 | 10/1904 | Smith | 266/272 |
| 2,177,716 | 10/1939 | Heuer | 266/165 |
| 3,203,689 | 8/1965 | Hallowell, Jr. | 266/286 |
| 3,398,945 | 8/1968 | Walpole | 266/272 |
| 3,540,627 | 11/1970 | Armstead | 266/272 |
| 4,298,191 | 1/1980 | Atkinson et al. | 266/165 |

*Primary Examiner*—L. Dewayne Rutledge
*Assistant Examiner*—Scott Kastler
*Attorney, Agent, or Firm*—Body, Vickers & Daniels

[57] ABSTRACT

A ladle car opening is closed during the period between pouring and subsequent refilling of the car with molten metal by a closure plug comprised of an open wire mesh support and a lining of fibrous insulating material attached thereto. The plug has a tapered configuration providing for the outer end thereof to be larger than the opening into the ladle car, and the wire mesh support and lining provides for the plug to be flexible so as to conform to the peripheral contour of the opening and to engage a peripheral outer edge of the opening to close the opening and retain the plug therein.

20 Claims, 7 Drawing Figures

FIG. 1
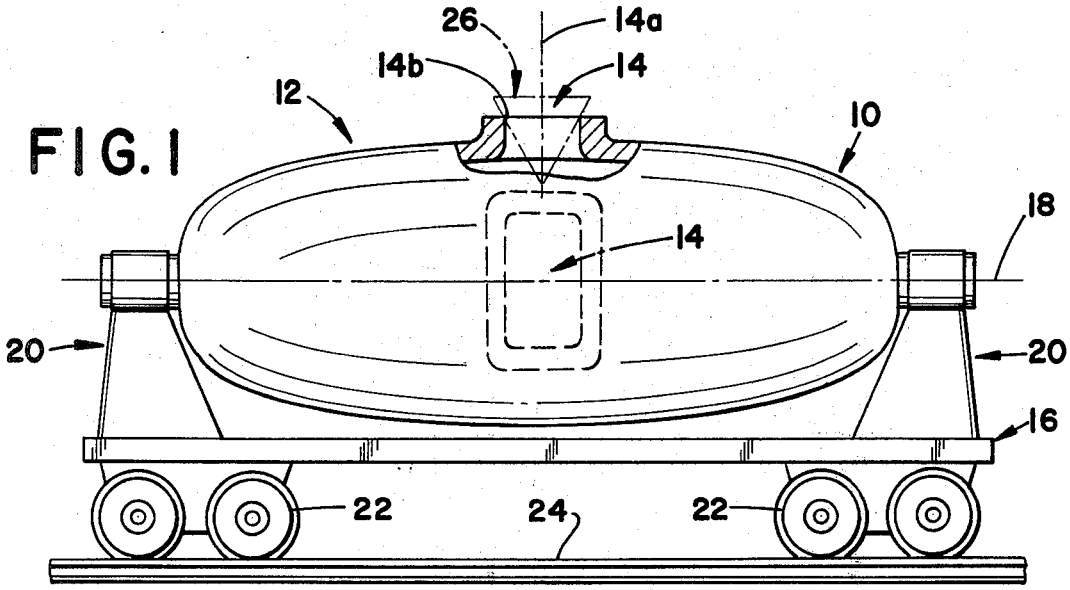
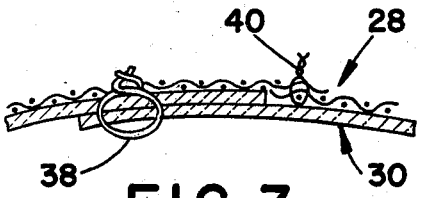
FIG. 3
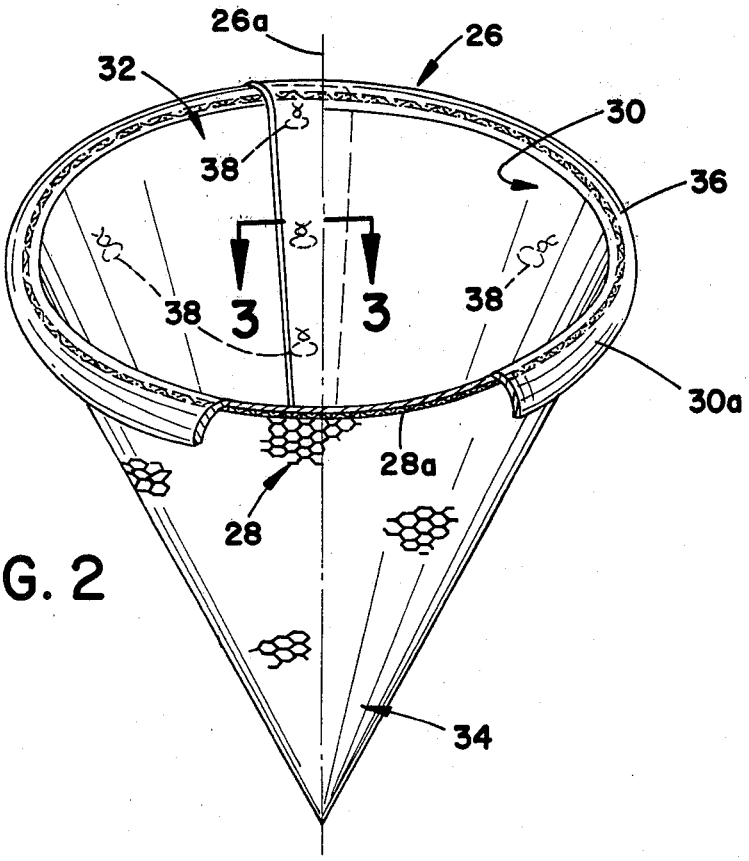
FIG. 2

CLOSURE PLUG FOR LADLE CAR

BACKGROUND OF THE INVENTION

This invention relates to the art of molten metal carrying ladle cars and, more particularly, to an improved closure member for closing the opening in the car between pouring and subsequent refilling operations.

It is of course well known that ladle cars, sometimes referred to as torpedo cars because of their shape, are employed for carrying molten metal from one location to another such as, for example, from a blast furnace location to a basic oxygen furnace location in a steel mill operation. As is further well known, such ladle cars include a container mounted on a wheeled frame structure for rotation relative thereto about a horizontal axis and which container includes an opening radially thereinto and through which molten metal is adapted to be poured into and from the container. More particularly in this respect, rotation of the container provides for the opening to be positioned vertically upwardly to facilitate pouring molten metal into the container and, thereafter, to be rotated in either direction about the horizontal axis to displace the opening outwardly and downwardly from the vertical position to facilitate pouring of the molten metal from the container. The supporting framework is mounted on wheels to enable transporting the car between the pouring and filling locations and, often, several cars are connected together to form a train.

Following the pouring of molten metal from a ladle car, it is desirable to retain the temperature within the container as high as possible during the period between pouring and the subsequent refilling of the container. Such temperature retention is desired so as to minimize the molten metal temperature loss during the period between refilling and the next pouring operation and which temperature loss results in part from the temperature drop in the container prior to refilling. Generally, there can be as much as a three to ten hour delay between pouring and refilling the ladle car. This delay can result in a loss of several hundred degrees of heat in the container piror to refilling and, thus, an undesirable reduction in the molten metal temperature between such refilling and the next pouring operation.

Efforts heretofore to minimize such heat loss during the period between pouring and refilling have included covering the ladle car container opening with a blanket of fibrous insulating material which is secured to circumferentially opposite sides of the container through the use of strapping arrangements. While such a blanket arrangement serves to reduce the loss, there are several disadvantages attendant to the use thereof. Among these disadvantages is the fact that the physical condition of the outer end of the opening into the container most often precludes an interengaging relationship between the blanket and opening to promote minimizing heat loss. In this respect, slag build up and/or erosion about the outer peripheral edge of the container opening, which results from pouring and filling operations, produces an irregular outer surface contour across which the blanket extends. Such irregularities promote leakage paths between the container opening and blanket and through which a considerable amount of heat can be lost during the period between pouring and refilling. Furthermore, the placing of such a blanket across the opening requires the use of a crane or the like to drop the blanket into position, and one or more men on the ground next to the car to achieve fastening of the blanket straps to the container. Accordingly, it will be appreciated that such a procedure is both time consuming and potentially hazardous to the workmen on the ground. As an alternative to the use of an overhead crane to initially position the blanket on the container, the blanket can be strapped to one side and the container rotated in the direction to displace the container opening toward the ground on the same side of the car, after which workmen on the latter side and through the use of rods or the like push the blanket across the opening so that strapping of the blanket to the opposite side of the container can be achieved by rotating the container opening back to the upper position thereof. Such an alternative procedure is not only time consuming but extremely hazardous to workmen in that the ladle car containers are never completely emptied, whereby the initial rotation of the container to displace the opening downwardly subjects the workmen to potential injury through the displacement of hot slag outwardly through the container opening.

In the refilling process with regard to ladle cars having such blankets of insulating material covering the container opening, the cover is not removed and the molten metal is poured into the container through the cover. Nonremoval of the cover is preferred in order to optimize heat retention in the container prior to refilling thereof, but a blanket type cover masks the location of the opening into the container. Therefore, refilling is either accompanied by guess work with respect to the appropriate positional relationship between the container opening and the stream of molten metal, which obviously can be extremely hazardous, or requires a workman to punch a hole or holes through the blanket to determine the location of the container opening thus to enable appropriate positioning of the car for refilling. Furthermore, since the insulating blankets are not removed it will be appreciated that several uses of the ladle car results in a build up of blanket material and straps, which build up can further increase heat losses by establishing heat loss paths between the outermost blanket and portions of the previously used blankets therebeneath. Still further, such a build up of blanket material must ultimately be removed from the ladle car, and this is a time consuming procedure during which there is an undesirable heat loss from the container.

SUMMARY OF THE INVENTION

In accordance with the present invention, a closure plug is provided for the opening of a ladle car which avoids the foregoing disadvantages, and others, attendant to the use of blanket like covers. More particularly in this respect, a closure plug according to the present invention is comprised of a flexible support component, preferably of flexible open mesh material, and a lining of fibrous insulating material thereon, and the plug is adapted to be received in the container opening and held in place therein without the use of fastening components. The plug has an open outer end and a closed inner end, and the flexibility of the plug enables the latter to conform to the basic geometrical peripheral configuration of the container opening. Preferably, the plug has a tapered contour providing for the open outer end to be larger than the container opening. This, together with the flexibility of the plug, enables a constrictive and self-conforming interengagement thereof with the irregular contour of the outer peripheral edge of the opening resulting from a slag build up and/or erosion, whereby the plug is self-retaining with respect to the opening and closes the opening so as to minimize heat loss during the period between pouring and refilling.

The configuration of the plug between the outer and inner ends thereof further facilitates the positioning thereof in the container opening by a single workman from a location laterally of and above the opening, such as through the use of a long pole or the like by which the plug is lowered into the opening. Still further, the plug configuration and flexibility thereof provide for the plug to be self-centering upon introduction into the container opening. Therefore, the plugging operation is advantageously achieved in a minimum amount of time, by a single workman, and by a procedure which promotes safety for the workman. Still further, the open outer end of the plug advantgeously provides a target facilitating appropriate positioning of the container opening for refilling operation, and the light weight flexible construction of the plug provides for the entire plug to be displaced into the container during the refilling operation, whereby there is no portion of the plug which has to be removed at a later time or which could interfere with desired closing of the opening following the subsequent pouring operation.

It is accordingly an outstanding object of the present invention to provide a light weight, flexible closure plug adapted to be received in the opening of a ladle car container and supported relative thereto independent of the use of separate fastenings and in a manner which optimizes heat retention in the container between pouring and refilling operations.

Another object is the provision of a closure plug of the foregoing character which is adapted to conform to the peripheral contour of the container opening and to interengage therewith to minimize heat loss across the container opening when the closure plug is in place.

A further object is the provision of a closure plug of the foregoing character which is adapted to be inserted into the container opening by a single workman in a minimum amount of time, and with minimum exposure to hazardous working conditions.

Yet another object is the provision of a closure plug of the foregoing character which facilitates appropriate positioning of the container opening to receive molten metal during a refilling operation, and which is displaced in its entirety into the container during the filling operation.

Yet a further object if the provision of a closure plug of the foregoing character constructed of a flexible supporting component and a lining of fibrous insulating material, and which closure plug is adapted to conform to the peripheral contour of the container opening and to be self-retaining with respect thereto.

Still another object is the provision of a closure plug of the foregoing character constructed of a supporting component of flexible open mesh material and a lining of fibrous insulating material, which closure plug is economic to manufacture both from the standpoint of material costs and construction time, and the contour of which together with the flexibility thereof provides for the plug to conform to the peripheral contour of the container opening and to constrictively interengage with the outer peripheral edge thereof so as to be self-retaining with respect to the opening while optimizing sealing interengagement therewith.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which:

FIG. 1 is a somewhat schematic side elevation view of a ladle car having an opening adapted to be closed by a closure plug in accordance with the present invention;

FIG. 2 is a perspective view of a closure plug made in accordance with the present invention;

FIG. 3 is a cross-sectional view through the wall of the plug taken along line 3—3 in FIG. 2;

DESCRIPTION OF A PREFERRED EMBODIMENT

Figure 7:
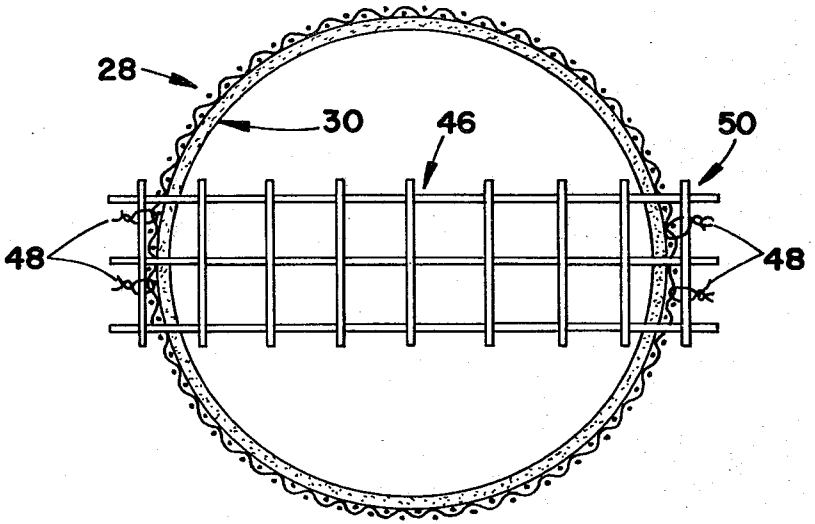

With reference now in greater detail to the drawings, wherein the showings are for the purpose of illustrating a preferred embodiment of the invention only and not for the purpose of limiting the invention, FIG. 1 somewhat schematically illustrates a ladle car 10 which, as is well known, includes a refractory lined container 12 having an opening 14 thereinto. Opening 14 has an axis 14*a* extending radially of container 12 and an outer peripheral edge 14*b* generally transverse to axis 14*a*. As is further well known, container 12 is mounted on a frame structure 16 for rotation relative thereto about longitudinal container axis 18 by means of support assemblies 20 at opposite ends of the container, and frame structure 16 is provided with wheels 22 by which the ladle car is adapted to be transported along tracks 24 between pouring and refilling locations. In connection with the use of such a ladle car, container 12 is filled by pouring molten metal into opening 14 when the latter is in the upright solid line position shown in FIG. 1, and molten metal is subsequently poured from container 12 through opening 14 by rotating the container about axis 18 so as to displace opening 14 to one side or the other of the car toward the broken line position of the opening shown in FIG. 1. Following the pouring of molten metal from container 12, the latter is rotated about axis 18 to displace opening 14 back to its upright position, after which a closure plug 26 constructed in accordance with the present invention is introduced into opening 14 to close the latter during the period between such pouring and the succeeding refilling operation.

While opening 14 is shown herein as being rectangular in geometrical contour, it will be appreciated that the geometrical contour of ladle car openings vary in geometrical configuration and may, for example, be square, oval, elliptical or round. As will become apparent hereinafter, a distinct advantage of a closure plug made in accordance with the present invention is the ability of the latter to conform not only to the basic geometrical contour of the container opening but also to irregularities in such contour resulting from slag build up and/or erosion along the outer peripheral edge of the opening.

With reference now to FIGS. 2 and 3 of the drawing, a closure plug 26 made in accordance with the present invention is comprised of a flexible support component 28, preferably of open mesh material as shown, and a lining 30 of fibrous insulating material suitably attached to support component 28. In the embodiment shown, closure plug 26 is initially of concial configuration having an axis 26*a* and which concial configuration provides the plug with an open outer end 32 and a closed inner end 34. For the purpose which will become apparent hereinafter in connection with the preferred embodiment, open outer end 32, as defined by outer peripheral edge 36, is larger in area than the area of opening 14 as defined by peripheral edge 14*b* thereof. Further, the conical configuration provides the plug with a circumferentially continuous wall which tapers inwardly of axis 26*a* from outer peripheral edge 36 to axis 26*a* at inner end 34 of the plug. The plug wall has an outer surface defined by open mesh support component 28 and an inner surface defined by lining 30.

Lining 30 may be in the form of a single mat or blanket of fibrous insulating material, or may be defined by a plurality of such mats or blankets adjacent one another and secured to support component 28 on the inner side thereof and, as will be seen from FIG. 3, such securing of the lining can be achieved by means of wire tie elements 38 penetrating through lining material 30 and open mesh component 28 and having outer ends twisted together as shown. Similarly, it will be appreciated that open mesh support component 28 can be provided by a single sheet of open mesh material or from a number of sheets having overlapping marginal edges connected together, again by the use of wire tie elements such as wire tie 40 shown in FIG. 3. While lining 30 could be otherwise secured to support component 28, such as by adhesive bonding, wire ties are preferred from the standpoint of economy and ease of assembly. Furthermore, while only a few such wire ties 38 are shown in FIG. 2, it will be appreciated that this is for simplicity in the drawing and that the number and locations of such ties with respect both to the support component 28 and lining 30 will be provided as required in accordance with fastening of the sheet or sheets of supporting material together and the adequate retention of the lining material in place thereon.

Preferably, support component 28 is defined by an open mesh wire, commonly known as chicken wire, having one inch or two inch openings, and a suitable material for lining 30 is a one inch blanket of flexible ceramic fiber insulating material available from the Carborundum Company of Niagara Falls, New York under the latter's trademark Durablanket.

The primary purpose of support component 28 is to maintain lining 30 in a generally planar condition while providing sufficient flexibility for the plug to conform to the basic geometrical contour of the container opening and sufficient rigidity to prevent collapse of the plug under its own weight when positioned in the container opening. Many materials will serve this purpose, whether of open mesh or imperforate sheet material character. An open mesh wire fabric of the foregoing character is preferred for support component 28 primarily from the standpoint of economics and ease of construction. However, it will be appreciated that other materials which provide the intended support function can be employed, as can other open mesh wire constructions or suitable high temperature resistant nonmetallic open mesh fabrics. Furthermore, while it is preferred to provide lining 30 on the inner side of support component 28, in that such arrangement facilitates better support for the lining and the use of fewer tie wires in connection with such support, it will be appreciated that the lining material could be provided on the outer side of support component 28 and suitably attached thereto. Still further, while it is preferred from the standpoint of economics and assembly time to employ blanket type fibrous insulating material for the lining, it will be appreciated that other types of insulating material can be employed, such as a wet insulating material dried in place on the support component, or with the latter embedded in the insulating material.

Figure 5:
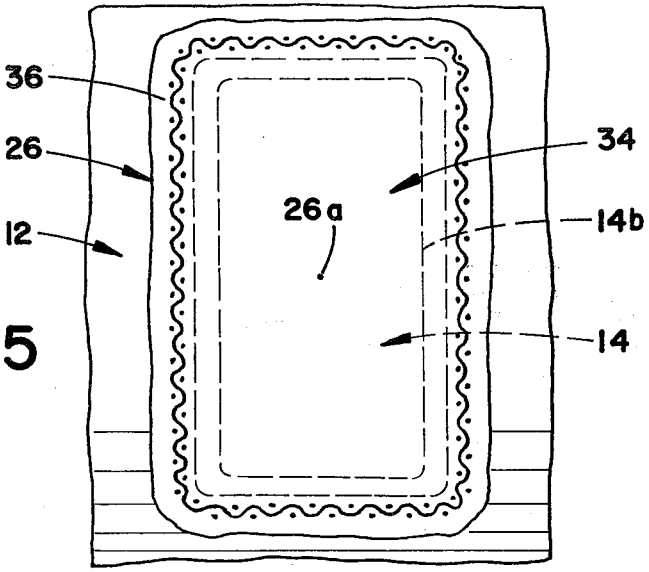
FIG. 5 is a plan view of the closure plug in the ladle car opening.
Figure 4:
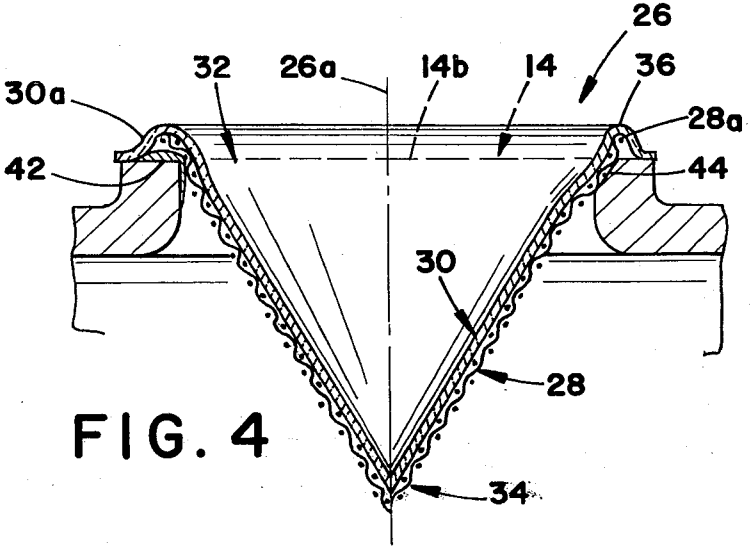
FIG. 4 is a sectional elevation view of the closure plug in position in the ladle car container opening.

The structural interrelationship between container opening 14 and closure plug 26 will be appreciated from the following description with reference to FIGS. 4 and 5 of the drawing wherein the closure plug is shown in place in the container opening. More particularly in this respect, closed inner end 34 of the closure plug extends into container opening 14 so as to be spaced axially inwardly of peripheral edge 14*b* of the container opening, and the larger area of peripheral edge 36 of the plug relative to edge 14*b*, together with the flexibility of the closure plug, provides for the plug to conform to the basic geometrical contour of peripheral edge 14*b* and to engage the latter edge with plug edge 36 above and radially outwardly thereof. As mentioned hereinabove, the filling and pouring of molten metal through opening 14 results in slag build up and/or erosion which provides irregularities in peripheral edge 14*b* of the opening. Such slag build up and erosion are schematically illustrated in FIG. 4 and respectively designated by numerals 42 and 44. The flexibility of closure plug 26 advantageously further enables the wall thereof to conform to the contour of such irregularities upon pushing the plug into the opening, thus to minimize the existence of leakage paths between the plug and peripheral edge 14*b* of the opening. Still further, such flexibility of the closure plug enables the latter upon being pushed into opening 14 to constrictively and thus frictionally interengage with peripheral edge 14*b* thus to promote good sealing interengagement therewith and retention of the plug in the opening against unintentional displacement outwardly of the opening. In connection with the latter, the provision of open mesh support component 28 on the outer side of the closure plug is to advantage in that the open mesh nature thereof cooperates with the rough nature of the slag build up to promote plug retention.

It will be further appreciated from FIG. 4 that the tapered configuration of the closure plug providing for peripheral edge 36 thereof to be both axially and radially offset with respect to peripheral edge 14*b* of the opening advantageously provides for the closure plug to be self-supporting against unintentional displacement into container 12 through opening 14 and without the use of fasteners or the like. It will be appreciated too that the concave contour of the closure plug relative to peripheral edge 14*b* of the opening provides a target denoting the location of opening 14, thus to facilitate accurate positioning of the ladle car for molten metal to be poured into container 12. In connection with the latter, the impact and weight of molten metal against closed inner end 34 when filling begins displaces the entire closure plug axially inwardly into container 12, such displacement resulting from the flexibility of the closure plug which enables radial construction of the plug wall under the impact and weight of the molten metal.

Preferably, lining material 30 extends axially beyond the outer peripheral edge 28*a* of support component 28 so as to provide a circumferentially continuous skirt portion 30*a* of the fibrous insulating material having a sufficient length beyond edge 28*a* to provide for the skirt to be displaced into overlying relationship with the neck portion of the container opening laterally outwardly of edge 14*b*. The flexible nature of the insulating material facilitates such displacement of the skirt portion and, furthermore, enables the latter to be poked or tucked, such as through the use of a long pole, radially inwardly toward edge 14*b*. As will be appreciated from the left hand side of FIG. 4, such tucking against slag build up 42, for example, enhances the sealing engagement between the plug and container opening.

The foregoing structural interrelationships between the closure plug and container opening, and the advantages derived therefrom, can be achieved with closure plug shapes other than the conical shape illustrated in the drawings. In this respect, for example, the closure plug could be in the form of a truncated cone, whereby the closed inner end of the plug would be defined by an inner end wall transverse to the plug axis. Further, a closure plug having such an inner end wall could be constructed for the latter and for the side walls of the plug to be of contour corresponding to that of the periphery of the container opening whereby, in connection with a rectangular container opening as shown in the drawings, the container plug would be formed so as to be generally rectangular in cross-section transverse to the axis thereof. In connection with the foregoing and other modifications of the structural contour of the closure plug, the side wall or side walls thereof would preferably be inclined and of an axial length providing for the interrelationship with the container opening shown in FIG. 4. In connection with the inclined wall characteristic and the sealing and plug retention capabilities provided thereby, it will be appreciated that the latter capabilities could be achieved with a modification of the embodiment illustrated herein which would provide for the portion of the support component extending above peripheral edge 14*b* of the opening to extend radially outwardly of the peripheral edge 14*b* so as to overlie the axially outer surface of the tubular neck of the container through which the receptacle opening extends. Such a radially extending portion on the outer end of the receptacle plug would enhance retention of the plug against unintentional displacement into the receptacle, while the flexibility of the open mesh support component would permit the necessary distortion and constriction of the plug for displacement thereof into the container under the impact and weight of molten metal during a filling operation. At the same time, the dimensional relationship between the peripheral edge of the container opening and the wall portion of the closure plug engaging therewith would provide the desired frictional interengagement for sealing and retention of the closure plug against displacement outwardly of the container opening.

While considerable emphasis has been placed hereinabove on the tapered wall configuration of the closure plug to promote the desired sealing and plug retention characteristics, it will be appreciated that such a tapered configuration is preferred primarily from the standpoint of economics in construction and ease of insertion of the plug into the container opening and into the desired interengaging relationship with the peripheral edge thereof. In this respect, with a tapered wall configuration it is only necessary to drop the closed end of the plug into the container opening and perhaps lightly tamp the outer peripheral edge of the plug axially to achieve radial constriction of the plug wall into conformity and frictional interengagement with the peripheral edge of the opening. The same sealing and frictional interengagement relationships could be achieved with a hat-shaped receptacle plug having a closed inner end wall and axially extending side walls parallel to the closure plug axis and which side walls would have a radially outwardly extending flange or the like at the axially outer ends thereof to overlie the container neck. In such a construction, the peripheral dimension of the side walls would be slightly greater than that of the peripheral edge of the container opening, and the flexibility of the closure plug permits sufficient constricting distortion of the side walls to facilitate pushing the closure plug into the opening such as through the use of a rod or pole introduced into the plug and pushed against the inner end wall thereof.

Figure 6:
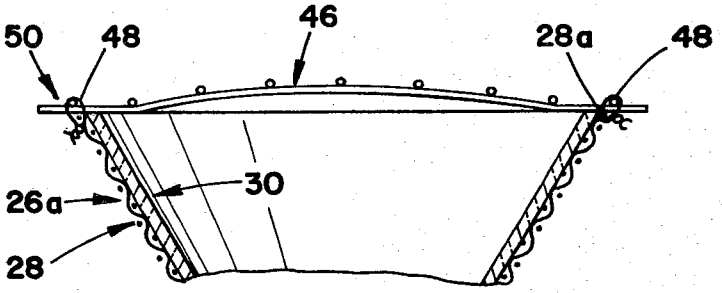
FIG. 6 is a sectional elevation view of a portion of a closure plug made in accordance with the present invention and showing a supplementary support component across the upper edges thereof; and, FIG. 7 is a plan view of the closure plug shown in FIG. 6.

A closure plug as described hereinabove can be inserted into a container opening in any number of different ways. For example, container 12 can be rotated to displace opening 14 to one side or the other of the car, and the closure plug can be supported on an elongated pole extending into the plug and which pole can be manipulated by a workman to push the plug into place. Preferably, from the standpoint of safety, the plug is lowered into the container opening with the latter in the upright position thereof by a workman in an elevated position laterally of the car. While a special gripping device could be provided on an elongated pole or rod for this purpose, such insertion is more readily and economically achieved by providing the closure plug with a handle-like component enabling the closure plug to be supported and manipulated into place by suspending it on the end of a pole. For example, as shown in FIGS. 6 and 7 of the drawing in connection with a closure plug 26*a* in which lining 30 terminates at upper edge 28*a* of support component 28, a wire screen component 46 extends across opposed portions of the upper peripheral edge 28*a* of support component 28 and is fastened thereto through the use of wire-tie elements 38. Preferably, screen component 46 is comprised of steel wire of from eight to twelve gauge. It will be appreciated that component 46 provides a handle-like portion under which the end of an elongated pole can be positioned so as to support the closure plug in suspension from the pole during manipulation of the latter to achieve insertion of the plug into the container opening. Preferably, screen component 46 includes end portions 50 each extending radially outwardly from the corresponding portion of peripheral edge 28*a* and, as will be appreciated with reference to FIG. 4 of the drawing, end portions 50 would radially overlie the neck portion of the container. Accordingly, such end portions 50 further assure against displacement of the closure plug into the receptacle prior to the pouring of molten metal thereinto should the closure plug become displaced axially inwardly of the container opening to the extent that the outer peripheral edge of the plug was adjacent peripheral edge 14*b* of the opening. It will likewise be appreciated that the provision of the closure plug with component 46 would enable axially shortening the outer end of the support component shown in FIG. 4 to the plane of peripheral edge 14*b*, whereby the plug would be primarily supported against unintentional displacement axially inwardly of the opening by end portions 50 of component 46.

While screen component 46 has sufficient strength for ends 50 to support the weight of the closure plug against unintentional displacement into the receptacle, the screen material will be melted and/or distorted upon the impact of molten metal thereagainst so as to lose its supporting capability, whereby the closure plug will be displaced into the container during the filling thereof with molten metal. Moreover, while wire screen component 46 advantageously provides the dual functions of a handle-like member and retention of the closure plug against unintentional displacement into the receptacle, it will be appreciated that such a wire screen component can be provided without the end portions so as to function only as a handle-like component, and that a handle component can be provided other than by such wire screen. For example, a single strand of wire can be suitably attached to the open mesh supporting component of the closure plug to facilitate plug insertion through the use of a rod or pole. Still further, while plug 26*a* in FIGS. 6 and 7 does not include skirt portion 30*a* of the lining material as shown in FIGS. 2 and 4, it will be appreciated that the fibrous lining material is easily cut, whereby slits can be cut in the lining material enabling a supplementary support and/or handle component of the foregoing nature to be readily attached to edge 28*a* of support component 28 of the plug shown in FIGS. 2 and 4.

While particular emphasis has been placed herein on the embodiment illustrated in the drawings, and certain modifications thereof, it will be appreciated that other embodiments of the invention as well as other modifications of the embodiment herein illustrated and described can be made without departing from the principles of the present invention. Accordingly, it is to be distinctly understood that the foregoing descriptive matter is to be interpreted merely as illustrative of the present invention and not as a limitation.

Having thus described the invention, it is claimed:

1. A closure plug for a ladle car container having an opening thereinto through which molten metal is poured into and from the container and which container opening has an axially outer end and a peripheral edge at said outer end, said closure plug having an axis and including wall means providing said plug with an open axially outer end and a closed axially inner end, said wall means comprising lining means of fibrous insulating material and flexible support means for lining said means, said support means being open mesh screen means, said plug being received in and closing said container opening with said closed inner end spaced axially inwardly of said peripheral edge of said opening.

2. A closure plug according to claim 1, wherein said wall means tapers radially inwardly of said plug axis in the direction from said axially outer end toward said axially inner end of said plug.

3. A closure plug according to claim 1, wherein said axially outer end of said plug includes a peripheral plug edge spaced radially outwardly of said peripheral edge of said container opening.

4. A closure plug according to claim 1, wherein said wall means includes a portion adjacent said axially outer end engaging against said peripheral edge of said container opening.

5. A closure plug according to claim 4, wherein said axially outer end of said plug includes a peripheral plug edge spaced axially outwardly of said portion of said wall means, and said wall means tapers radially inwardly of said plug axis from said peripheral plug edge toward said axially inner end of said plug.

6. A closure plug according to claim 5, wherein said wall means tapers from said peripheral plug edge to said plug axis at said inner end of said plug.

7. A closure plug according to claim 1, and handle means extending across said open end of said plug and fastened to said support means.

8. A closure plug according to claim 1, wherein said open axially outer end of said plug includes a peripheral plug edge, and plug support means fastened to said support means and extending radially outwardly of said peripheral plug edge.

9. A closure plug according to claim 1, wherein said support means has an outer peripheral edge at said open outer end, and said lining means includes a peripheral skirt portion radially outwardly of said peripheral edge of said support means.

10. A closure plug according to claim 1, wherein said wall means has inner and outer sides, said outer side being defined by said flexible support means, and said inner side being defined by said lining means.

11. A closure plug according to claim 10, wherein said lining means includes mat means of fibrous insulating material attached to said flexible support means.

12. A closure plug according to claim 11, wherein said open mesh screen means is wire screen means.

13. A closure plug according to claim 10, wherein said wall means includes a portion adjacent said axially outer end engaging against said peripheral edge of said container opening.

14. A closure plug according to claim 13, wherein said axially outer end of said plug includes a peripheral plug edge spaced axially outwardly of said portion of said wall means, and said wall means tapers radially inwardly of said plug axis from said peripheral plug edge toward said axially inner end of said plug.

15. A closure plug according to claim 14, wherein said lining means includes mat means of fibrous insulating material attached to said flexible support means.

16. A closure plug according to claim 15, wherein said open mesh screen means is wire screen means.

17. A closure plug according to claim 16, wherein said support means has an outer peripheral edge at said open outer end, and said lining means includes a peripheral skirt portion radially outwardly of said peripheral edge of said support means.

18. A closure plug according to claim 17, and handle means extending across said open end of said plug and fastened to said support means.

19. A closure plug according to claim 18, wherein said wall means tapers from said peripheral plug edge to said plug axis at said inner end of said plug.

20. A closure plug according to claim 16, and plug support means fastened to said wire screen means and extending radially outwardly of said peripheral plug edge.

* * * * *